United States Patent [19]

Michelman et al.

[11] 4,096,718

[45] * Jun. 27, 1978

[54] TAMPER-PROOF LOCKING DEVICE

[75] Inventors: Lionel S. Michelman, Pomona; Samuel M. Michelman; David L. Michelman, both of Queens; Milton Michelman, Long Beach, all of N.Y.

[73] Assignee: Michelman Iron Works Corp., Brooklyn, N.Y.

[ * ] Notice: The portion of the term of this patent subsequent to Jun. 28, 1994, has been disclaimed.

[21] Appl. No.: 783,274

[22] Filed: Mar. 31, 1977

Related U.S. Application Data

[63] Continuation-in-part of Ser. No. 693,293, Jun. 7, 1976, Pat. No. 4,031,722.

[51] Int. Cl.[2] ..... E05B 65/52; E05B 67/38; E05C 19/18

[52] U.S. Cl. ..... 70/63; 70/417; 70/54; 292/288; 292/258

[58] Field of Search ..... 70/54, 55, 56, 63, 417, 70/32–34, 77–78; 292/258, 256, 256.5, 288, 340

[56] References Cited

U.S. PATENT DOCUMENTS

| | | | |
|---|---|---|---|
| 3,727,438 | 4/1973 | Knaack | 70/56 |
| 3,968,985 | 7/1976 | Nielsen | 70/63 |
| 4,031,722 | 6/1977 | Michelman | 70/63 |

FOREIGN PATENT DOCUMENTS

| | | | |
|---|---|---|---|
| 1,292,033 | 4/1969 | Germany | 70/63 |

*Primary Examiner*—Robert L. Wolfe
*Attorney, Agent, or Firm*—Kirschstein, Kirschstein, Ottinger & Cobrin

[57] ABSTRACT

A locking device composed of two strips of metal bent into specific configurations, and a U-shaped baffle, to provide a tamper-proof assembly when emplaced on a lidded container. A first strip is fixed to the container by a concealed screw within the container. The second strip overlies the lid and includes a portion superposed over a portion of the one strip. The baffle is fixed to the second strip. The aforesaid portions of the strips are provided with registered holes through which the shackle of a padlock is threaded to lock the assemblage in place and prevent the opening of the lid. The baffle is couplable to the first strip and inhibits relative rotation of the strips about the common axis of the holes. The invention is applicable for locking any lidded boxes or containers, e.g. electric meter wiring cabinets, to prevent the tampering with elements within the box such as service wires interposing an electric meter between power lines and house lines.

19 Claims, 4 Drawing Figures

TAMPER-PROOF LOCKING DEVICE

CROSS-REFERENCE TO RELATED APPLICATION

The present application is a continuation-in-part of U.S. patent application Ser. No. 693,293 filed June 7, 1976, now U.S. Pat. No. 4,031,722 issued June 28, 1977.

BACKGROUND OF THE INVENTION

1. Field of the Invention

The invention relates to a tamper-proof locking device for lidded containers, to be used in conjunction with a padlock.

2. Description of the Prior Art

The necessity for locking containers is widely understood. Perhaps the most ubiquitous locking means and device of the prior art is a simple hinged hasp, i.e. a fastener for a door or lid consisting of a hinged metal strap provided with a slot, which fits over a staple and is secured by a pin or padlock. Such simple devices are objectionable for usage where inspection of the container is not frequent, e.g. in the case of meter wiring cabinets which contain the service wires that are connected to an electric meter, since a simple hasp is not tamper-proof. A major problem of electric utility companies, especially in urban areas, is that the wiring cabinets are broken open and the wires are tampered with to shunt the meter so that the customer can receive electricity without it being recorded. There are literally thousands of these boxes and cabinets in the average electric utility system which do not have any provision for a lock, or which are readily opened because, as presently constituted, they merely have a hasp or the like and are not tamper-proof.

Pertinent prior art in this field includes U.S. Pat. Nos. 3,938,939 and 3,968,985; and German Pat. No. 1,292,033.

SUMMARY OF THE INVENTION

Purposes of the Invention

It is an object of the present invention to provide a tamper-proof locking device.

Another object is to provide an improved locking device for the locking of cabinets, boxes, or any container provided with a lid.

A further object is to provide a locking device for the lid of a container which does not have any in situ provision for a lock.

An additional object is to provide a locking device which can be used on many different varieties and sizes of lidded boxes or containers of any type.

Still another object is to provide a locking device which is readily and simply installed.

Still a further object is to deter crime by providing a locking device which makes lidded containers tamper-proof.

Another object is to provide a universal locking device for the locking of a cover or lid on a vessel or container.

Another object is to provide a locking device which can be installed without destroying, cutting or drilling, or otherwise modifying, a lidded container.

Another object is to provide a locking device for a lidded box or the like, which is installed in place without being permanently attached to the box.

These and other objects and advantages of the present invention will become evident from the description which follows.

Brief Description of the Invention

In the present invention, a tamper-proof locking device is provided which is characterized by the provision of two strip members and a U-shaped baffle, which are usually composed of a rigid metal such as steel, wrought iron, brass or aluminum. Among the various types of steel which may be used, mild steel or case-hardened steel are preferred. The first strip member is of generally zig-zag or stepwise configuration and has two generally right-angled bends that divide the first member into three sections. None of the sections is opposite to another section, i.e. each bend is in an opposite direction from the adjacent bend or bends, so that each section is perpendicular to adjacent sections without being registered with another section, and a step-wise configuration is attained. An end section is provided with at least one opening, i.e. a hole to accommodate the emplacement of the shackle of a padlock-like fastening device. A U-shaped baffle is fixed on this end section perpendicular thereto so as to partially enclose and surround the opening.

The second strip member has a generally U-shaped section and a planar section. As will appear infra, the U-shaped section serves to affix the second member on an edge of a box or other lidded container, while the planar section is provided with at least one opening or hole to accommodate the shackle mentioned supra. The U-shaped section is provided with a first leg and a second leg, the planar section extending laterally outwards perpendicularly to the lower end of the first leg. The second leg has a threaded opening through which screw means, e.g. a set screw, extends generally transversely to the second leg, so that the second member is secured to an edge of the open container by inverting the U-shaped section, manipulating the second member relative to the container edge so that the edge of the container enters the U-shaped section and contacts the inner surface of the base of the U-shaped section and the legs straddle the edge and a wall of the container, and then turning the screw until the tip of the screw is forced against the inner side of the wall of the container. The screw is located within the container so as to be concealed and protected when the container lid is closed. The lid then is closed and the first member emplaced so that an end section rests on top of the lid, the next (second) section overlies the aforesaid wall of the container and the next (third) section, this being the section with the opening therein, overlies the planar section of the second member. The opening in the inner section is aligned with the opening in the planar section of the second member. Thus, the two members are now attachable to each other, and the container is locked shut in a tamper-proof manner, by the provision of a padlock the shackle of which extends through the aforesaid openings.

The tip of the planar section of the second member extends into a slot in the U-shaped baffle. The inner surfaces of the baffle are adjacent the sides of the planar section of the second member to inhibit relative angular movement of the two members about the shackle, while the placement of the tip of the planar section in the baffle slot and reception of the padlock wholly within the baffle inhibits jimmying of the device.

In most instances, both of the strip members generally will be of the same width; however, it is preferred that the first member be somewhat thicker than the second member, since structural rigidity and strength is more important and requisite for the first member, in order to prevent the bending, twisting or rotating of the first member which would allow a criminal easily to gain access to the interior of the container. A single sturdy padlock such as a barrel lock usually will be sufficient, and thus only a single hole ordinarily will be provided in the third section of the first strip member and also in the planar section of the second strip member.

The locking device of the present invention presents several salient advantages. The device essentially is tamperproof, and thus the considerations developed above with regard to electric meter wiring cabinets or the like present an exemplary utility for the device. The device readily is installed in place without being permanently attached to the container or box or the like, and the locking device is installed without destroying, cutting or drilling, or otherwise modifying, the lidded container. The device is a universal locking device applicable to the locking of a cover or lid on a vessel or container or the like, or for the locking of virtually any enclosure elements which meet at substantially a right angle. The device deters crime with a locking device which makes lidded containers or the like essentially tamperproof. The device is readily and simply installed, and may be used on many different varieties and sizes of lidded boxes, cabinets, or containers or the like, of any type. The term "lid" in this regard will be understood to encompass and include various types of doors, e.g. a door on a bathroom medical cabinet, in which instance the device could prevent children from swallowing deleterious, dangerous or poisonous medicines and the like often found in home medical cabinets. An important advantage is that the device is applicable where there is no in situ provision for a lock.

The invention accordingly consists in the features of construction, combination of elements and arrangement of parts which will be exemplified in the device hereinafter described and of which the scope of application will be indicated in the appended claims.

BRIEF DESCRIPTION OF THE DRAWINGS

In the accompanying drawings in which are shown various possible embodiments of the invention.

DETAILED DESCRIPTION OF THE PREFERRED EMBODIMENTS

Figures 1, 2, 3, 4:
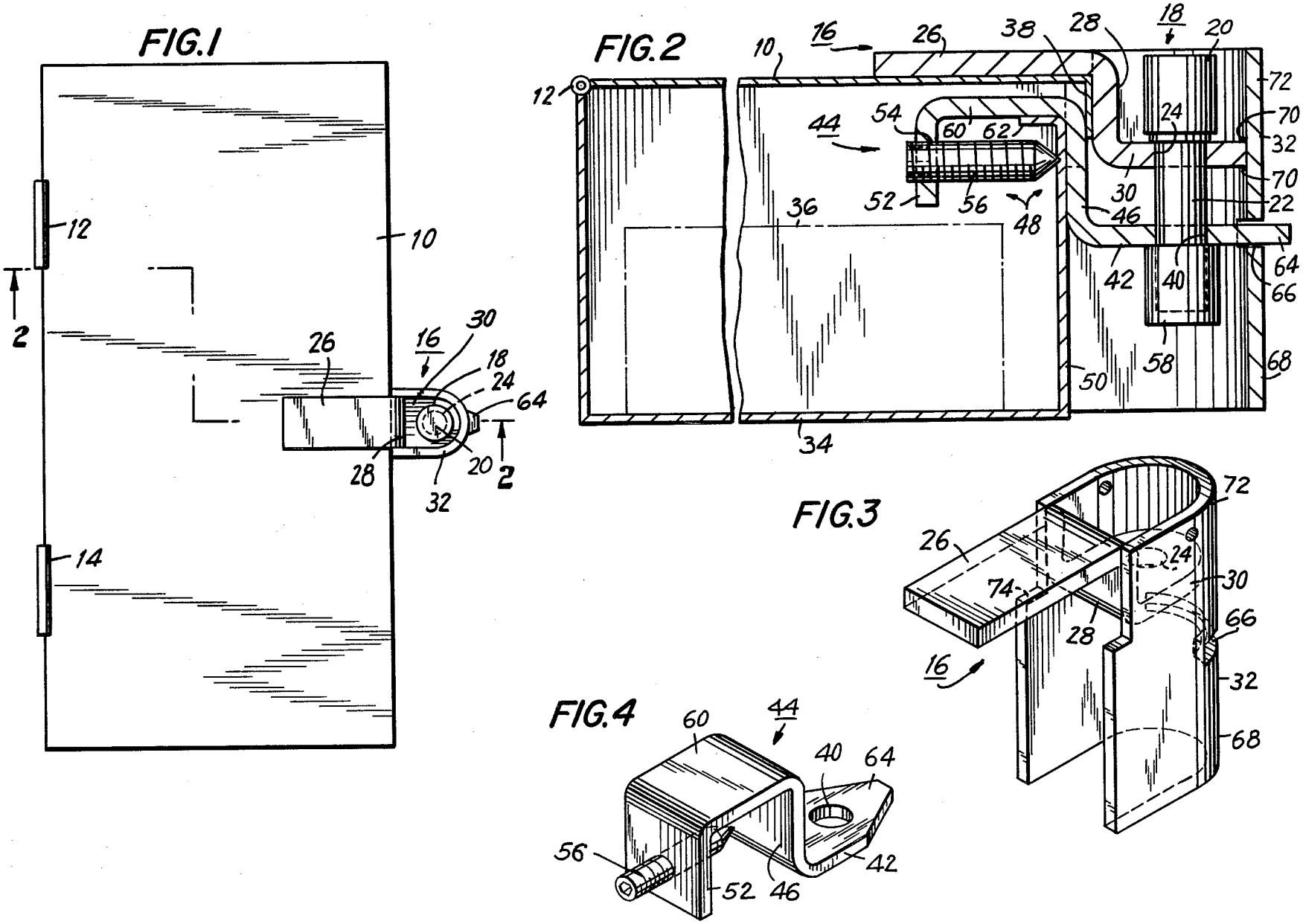
FIG. 1 is a plan view of the completed assemblage in place.
FIG. 2 is a fragmentary sectional elevational view taken substantially along the line 2—2 of FIG. 1, and showing details of the locking device.
FIG. 3 is a perspective view of the first member.
FIG. 4 is a perspective view of the second member and baffle.

Referring now to FIGS. 1 and 2, a lid 10 of a container such as an electric meter wiring cabinet is shown. The lid 10 is hinged to a container on one side by hinges 12 and 14, and the lid 10 is adapted to be locked to the opposite side wall to the container, not shown in this figure, by a locking device first member 16 of the present invention, which locking device first member 16 is secured by a lock 18, that typically is a barrel lock as shown, having an upper head 20 and a dependent barrel 22 fixed thereto into which a key must be inserted to open the lock 18. The barrel 22 extends through an opening 24 in the member 16 in which it is a snug to loose fit that permits no more than negligible play therebetween. Only the first member 16 of the device can be seen in FIG. 1. This member 16 constitutes a first section 26 which rests on the outer surface of the lid 10 adjacent the side wall of the container remote from the hinges 12, 14, a second section 28 which depends from the outer end of the section 26 at a generally right angle and overlies the outer surface of said side wall of the container and a third section 30 which extends perpendicularly outwardly from the lower end of the section 28 and is provided with the opening 24. A U-shaped baffle 32 which is secured, as by welding perpendicularly around the end of the section 30. The baffle extends above and below the section 30 sufficiently to receive the lock 18 when the container is closed and locked. The aforesaid dispositions of the various sections of the first member 16 are with the lid 10 in a closed position. It will be apparent that the lid 10 may be suitably disposed on the top, or a side, or on the bottom of a container, depending on circumstances and usage.

Referring now to FIG. 2, the first member 16 is shown mounted on a container 34 (above alluded to) provided with the lid 10. Within the container 34 is an element 36, shown in phantom outline, which it is desired to protect against unnoticed tampering, e.g. the connecting wires and junctions for an electric meter wiring cabinet. All edges but the hinged edge of the lid 10 typically are provided with a depending lip 38. However, such a lip is optional and may be omitted.

The sections 26,28 and 30 form, in combination, the first member 16 of the locking device and, as shown, the sections 26, 28 and 30 are oriented in the stepwise or right-angled zig-zag configuration. The barrel 22 of the lock 18 extends through the opening 24 in the section 30 in the fashion above noted and through a subjacent corresponding registered opening 40 in a planar section 42 of a second member 44 of the locking device in a similar fashion thus inhibiting any substantial relative rotational movement between the members 16 and 44. The planar section 42 protrudes, i.e. extends outwardly, from the lower end of a first leg 46 of a generally U-shaped section 48 of the member 44, which section 48, as shown, is inverted and mounted on a side wall 50 of the container 34 remote from the hinges 12, 14, so that the inner surface of the base of the section 48 rests on the upper edge of the wall 50 adjacent to the lid 10 when closed thereon. The section 48 is provided with a second leg 52 which is completely within the container 34 and is concealed when the lid is closed. The second member 44 is secured to the container 34 by a threaded bore 54 in the leg 52, through which a screw means 56, that is preferably a set screw, is turned until the tip of the screw means 56 contacts and forceable presses against the inner surface of the wall 50 to securely fix the second member thereto. This, of course, is done while the lid 10 of the container 34 is raised to permit access to the interior of container 34. Thereafter, the lid 10 is closed, the first member is emplaced, and lock 18 is attached to the device.

As shown, the lock 18 is provided with a cap member 58, which is securable to the barrel 22 by inserting a pin key, not shown, axially downwardly through the headed end 20 of the barrel 22 to release an inner latch so that the cap member 58 is slidably movable upwardly, after which the pin key is removed so that the inner latch snaps outwardly into an inner groove within the cap member 58 to retain the cap member on the other end of the barrel.

In this embodiment of the invention, it is to be noted (FIG. 2) that the first member sections 26, 28 and 30 are thicker than the second member sections 42 and 48, for added strength and rigidity. In addition, the U-shaped section 48 is provided with a wide planar base section 60 extending between legs 46 and 52, to accommodate for instances when an inwardly extending lip such as lip 62 is provided at the upper edge of the wall 50. Thus, the legs 46 and 52 are spaced apart sufficiently to receive the second member 44 on the upper edge of the wall 50. Concomitantly, the screw means 56 is long enough to reach from the leg 52 to the inner surface of the wall 50.

Other features of the invention are shown in FIGS. 1 and 2. A tapered projection 64 extends from the end of the planar section 42 of the second member 44. The projection 64 extends into a slot 66 in the lower portion 68 of the U-shaped baffle 32. In addition to the lower dependent portion 68 of baffle 32, this baffle 32 is also preferably provided with an upper portion 72 opposite to section 28, which portions 68, 72 surround the barrel lock to protect the locking device from tampering by a criminal.

FIGS. 3 and 4 show details of the first and second members 16 and 44, respectively, in enlarged perspective views. The structural characteristics of these members are thus readily apparent.

In the device as installed on a closed container, the second member 44 is seated on the container side wall 50 remote from the hinges 12, 14 with its leg 52 within the container and fastened to the wall 50 by the set screw 56. The other leg 46 is flat against the outer surface of the wall 50. The section 42 extends away from said wall 50. Thus, the second member is secured rigidly to the container and cannot readily be removed from it as long as the lid remains closed. The first member 16 simply rests on the container. Its first section 26 lies on the outer surface of the lid at the portion of the lid remote from the hinges 12, 14 and aligned with the second member. The outer end of the first section 26 reaches the edge of the lid. The second section 28 of the first member extends vertically downwardly from the first section to overlie the associated segment of the lid 10 and the leg 46 of the second member. The third section 30 of the first member overlies the section 42 of the second member. The U-shaped baffle 32 surrounds the barrel lock 18, whereby to protect and conceal the same, and the projection 64 extends through the slot 66 so as to minimize relative angular movement of the members 16, 44 about the central axis of the barrel 22, the sides of the barrel being close to the sides of the planar section 42. Thereby, once the barrel lock 18 is engaged and the barrel 22 fills the holes 24, 40, the first member only can shift slightly with respect to the fixed second member so that the lid is locked in closed position and is most difficult to remove with a wrench or a pry, common tools of a criminal.

It thus will be seen that there is provided a tamper-proof locking device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. A tamper-proof locking device mountable on a lidded container or the like comprising a first member and a second member, said first member being divided into a first, a second, and a third section in series at substantially right angles to each other, the third one of said sections being provided with at least one opening, said second member comprising a strip having a generally U-shaped section and projecting section, said U-shaped section having a first leg and a second leg, said projecting section extending laterally outwards from and substantially perpendicular to the lower end of the first leg of said U-shaped section and being provided with at least one opening, the second leg of said U-shaped section being provided with a threaded bore, and screw means extending through the bore in said second leg, so that the locking device is mountable on a lidded container by placing the U-shaped section of the second member on a wall of a container with said legs straddling said wall and with said second leg and said screw means within the container, turning said screw means until the tip of said screw means contacts and presses against the wall of the container, closing the lid of the container so that the edge of the lid rests on the base of said U-shaped section, and mounting said first member on both the edge of the lid and the projecting section of the second member with the first section of the first member extending over the edge of the lid, the second section of the first member overlying the first leg of the U-shaped section, and the third section of the first member extending substantially over the projecting section of the second member, so that said members are attachable to each other by lock means having a shackle extending through the opening in said third one of said sections of said first member and the opening in said projecting section of said second member, said first member having another section functionally unitary therewith to cooperate with said projecting section to inhibit relative angular movement of the two members about the shackle.

2. The locking device of claim 1 in which the locking means is a barrel lock.

3. The locking device of claim 1 in which the another section of the first member depends from the terminus of the third section of the first member and is provided with a slot, the projecting section of the second member being receivable in said slot.

4. The locking device of claim 3 in which the projecting section of the second member is tapered.

5. The locking device of claim 1 in which the another section of the first member is a U-shaped baffle secured and perpendicular to the third section of the first member, with its inner surfaces adjacent to the side edges of the projecting section of the second member.

6. The locking device of claim 5 in which the baffle laterally surrounds the lock means.

7. A tamper-proof locking device mountable on a lidded container or the like comprising a first member and a second member, said first member being divided into a plurality of sections in series, each section being at an angle to adjacent sections, an attachment section of said first member being provided with at least one opening, said second member comprising means mountable on the wall of a container together with a projecting section, said projecting section extending laterally outwards from said mounting means and being provided with at least one opening, so that the locking device is mountable on a lidded container by mounting said second member on a wall of the container adjacent the lid of the container with said projecting section extending outwards from the wall of the container, and mounting said first member on the projecting section of the second member with a section of the first member extending over the edge of the lid, and the attachment section of the first member extending substantially over the projecting section of the second member, lock means having a shackle extending through the opening in said attachment section of said first member and the opening in said projecting section of said second member, to attach said members to each other, said first member having another section functionally unitary therewith to cooperate with said projecting section to inhibit relative angular movement of the two members about said shackle.

8. A tamper-proof locking device mountable on a lidded container or the like comprising a first member and a second member, means for detachably mounting said second member on and externally of a wall of the container adjacent the interface between said wall and the lid of the container, said second member having an outwardly projecting section below the lid, said outwardly projecting section being provided with at least one opening, said first member being mountable on the projecting section of the second member, a first portion of said first member being provided with at least one opening, the opening in said first portion of said first member being aligned with the opening in the projecting section of said second member, a lock having a shackle extending through said openings, said first member including a second portion overlying the lid, said first member having means disposed about said first portion of the first member so that when said first member is emplaced, both the projecting section of the second member and the first portion of the first member are laterally surrounded, said first and second members including cooperating portions to inhibit relative rotation of said members about said shackle, said detachable mounting means being inaccessible when the device is emplaced on said lidded container.

9. The locking device of claim 8 in which the lock is a barrel lock.

10. The locking device of claim 8 in which the means of the first member disposed about the first portion of the first member is a substantially U-shaped baffle.

11. The locking device of claim 10 in which the end of the substantially U-shaped baffle which is spaced away from the first portion of the first member is open.

12. The locking device of claim 10 in which the U-shaped baffle is substantially perpendicular to the portions of the first member.

13. The locking device of claim 8 in which the means disposed about the first portion of the first member depends from the first member and is provided with a slot, the outer end of the projecting section of the second member being receivable in said slot.

14. The locking device of claim 8 in which the means of the first member is a U-shaped baffle secured and perpendicular to the first member, with the inner surfaces of said U-shaped baffle adjacent to the side edges of the projecting section of the second member.

15. The locking device of claim 14 in which the U-shaped baffle is provided with a slot, the outer end of the projecting section of the second member being receivable in said slot.

16. A tamper-proof locking device mountable on a lidded container or the like comprising a first member and a second member, means for detachably mounting said second member on and externally of a wall of the container adjacent the interface between said wall and the lid of the container, said second member having an outwardly projecting section below the lid, said outwardly projecting section being provided with at least one opening, said first member being mountable on the projecting section of the second member, said first member including a portion overlying the lid and a substantially U-shaped baffle disposed substantially perpendicular to said section, said first member including another portion provided with at least one opening, the opening in said another portion of said first member being aligned with the opening in the projecting section of said second member, a lock having a shackle extending through said openings, said substantially U-shaped baffle laterally surrounding said projecting section of the second member, said another portion of said first member, and said lock, so that relative rotation of said members about said shackle is inhibited, said detachable mounting means being inaccessible when the device is emplaced on said lidded container.

17. The locking device of claim 16 in which the lock is a barrel lock.

18. The locking device of claim 16 in which the substantially U-shaped baffle is provided with a slot, the outer end of the projecting section of the second member being receivable in said slot.

19. The locking device of claim 16 in which the end of the substantially U-shaped baffle which is spaced away from the portions of the first member is open.

* * * * *